US005874390A

United States Patent [19]

Gong et al.

[11] Patent Number: 5,874,390

[45] Date of Patent: Feb. 23, 1999

[54] AQUEOUS MACHINING FLUID AND METHOD

[75] Inventors: Deli Gong, Cincinnati; Kevin H. Tucker, Blanchester, both of Ohio

[73] Assignee: Cincinnati Milacron Inc., Cincinnati, Ohio

[21] Appl. No.: 995,364

[22] Filed: Dec. 22, 1997

[51] Int. Cl.[6] ..... C10M 135/02; C10M 173/00

[52] U.S. Cl. ..... 508/273; 508/322; 508/331; 508/335; 508/344

[58] Field of Search ..... 508/273, 322, 508/331, 335, 344

[56] References Cited

U.S. PATENT DOCUMENTS

| | | | |
|---|---|---|---|
| 2,524,017 | 9/1950 | Hance et al. | 252/33.4 |
| 3,027,324 | 3/1962 | Rosenberg . | |
| 3,929,652 | 12/1975 | Seni et al. | 508/273 |
| 4,210,544 | 7/1980 | Burton et al. | 508/273 |
| 4,315,889 | 2/1982 | McChesney et al. | 508/273 |
| 4,456,540 | 6/1984 | Recchuite | 252/48.6 |
| 4,485,044 | 11/1984 | Kammann et al. | 260/399 |
| 4,609,480 | 9/1986 | Hata et al. | 508/273 |
| 4,612,129 | 9/1986 | DiBiase et al. | 508/273 |
| 4,648,985 | 3/1987 | Thorsell et al. | 252/32.5 |
| 4,906,393 | 3/1990 | Farng et al. | 252/47.5 |
| 4,978,465 | 12/1990 | Sturwold . | |
| 5,298,177 | 3/1994 | Stoffa | 252/18 |
| 5,318,712 | 6/1994 | Lange et al. | 252/47.5 |
| 5,368,758 | 11/1994 | Gapinski | 252/42.7 |
| 5,391,310 | 2/1995 | Krueger et al. | 508/273 |
| 5,427,700 | 6/1995 | Stoffa | 252/18 |

FOREIGN PATENT DOCUMENTS

| | | | |
|---|---|---|---|
| 0066842 | 6/1981 | European Pat. Off. | C10M 3/04 |
| 0033170 | 8/1981 | European Pat. Off. | C10M 1/06 |
| 0062891 | 10/1982 | European Pat. Off. | C10M 3/04 |
| 0068061 | 1/1983 | European Pat. Off. | C10M 1/32 |
| 0586258 | 3/1994 | European Pat. Off. | C10M 159/20 |
| 0592956 | 4/1994 | European Pat. Off. | C10M 135/00 |
| 0593263 | 4/1994 | European Pat. Off. | C10M 135/00 |
| 0657522 | 6/1995 | European Pat. Off. | C10M 129/92 |
| 8703613 | 6/1987 | WIPO | C10M 173/00 |
| 8801272 | 2/1988 | WIPO | C10M 9/65 |
| 8803552 | 5/1988 | WIPO | C10M 14/08 |
| 8803554 | 5/1988 | WIPO | C10M 135/22 |
| 8905848 | 6/1989 | WIPO | C10M 173/00 |
| 9611247 | 4/1996 | WIPO | C10M 173/00 |

*Primary Examiner*—Margaret Medley
*Attorney, Agent, or Firm*—John W. Gregg; Donald Dunn

[57] ABSTRACT

An aqueous machining fluid admixture comprises water, a sulfurized oil and a water soluble salt of a dimercaptothiadiazole wherein the weight ratio of the sulfurized oil to the water soluble salt of dimercaptothiadiazole is in the range of from about 15:1 to about 45:1. A method employs the fluid by applying the fluid at the interface between tool and workpiece in shaping or working operations of metallic and solid non-metallic workpieces. The fluid is particularly effective in grinding operations to produce improved grinding ratios.

20 Claims, No Drawings

AQUEOUS MACHINING FLUID AND METHOD

BACKGROUND OF THE INVENTION

I. Field of the Invention

The invention pertains to aqueous machining fluid admixtures employed in the shaping and working of metal and solid non-metallic workpieces and to processes using the machining fluid admixture. Additionally the invention pertains to aqueous machining fluid admixtures containing sulfurized oil and dimercaptothiadiazole salt components which exhibit improved machining performance.

Machining operations mechanically work and shape metallic and solid non-metallic workpieces by cutting and non-cutting operations. The cutting processes include, for example, grinding, turning, drilling, milling, tapping and broaching. Non-cutting processes may include, for example, rolling, drawing, extruding, drawing and ironing, punching, stamping and spinning.

Machining fluids are generally broadly classified into two categories, namely oils, or "straight" oils (i.e. non-aqueous fluids) which are based on oils, and aqueous fluids which are based on water. Both categories commonly include one or more additives, such as, for example, extreme pressure agents which maintain lubricating properties even when subjected to extreme pressure, corrosion inhibitors which reduce or prevent corrosion of tools, workpieces and other items contacted by the fluids, bactericides and/or fungicides which reduce or prevent microbial attack of fluid constituents, and odor control agents.

Aqueous based machining fluids comprise complex combinations of water, lubricant, surfactants, foam control agents, and additives according to the intended application. The surfactants are used to form stable suspensions of water insoluble components in the aqueous fluid base and the foam control agents reduce or prevent the generation of foam. Aqueous based fluids are far less flammable than oils, are typically more readily disposed of and less costly. However, aqueous based fluids can be less effective at reducing friction than oil based fluids and hence perform less favorably as reflected in such measures as cutting force or grinding ratio (G-ratio), i.e. in grinding operations the ratio of metal removed to volume of wheel consumed in machining.

II. Description of Related Art

Many oil based machining fluids employ sulfurized oils to achieve effective friction reduction in machining operations. These sulfurized oils often have a high sulfur content which contributes to generation of undesired odors and fumes from heat generated in a machining process. To overcome relative performance deficiencies of aqueous fluids, it has been known to employ sulfonated oil and/or sulfurized oils as lubricants, especially in fluids for grinding operations. For example, use of sulfurized oils in aqueous based fluids is known from U.S. Pat. Nos. 5,391,310, 5,368,758, 5,318,712, 4,978,465, and 3,027,324. Generally, the improved cooling properties of aqueous fluids reduces or eliminates the contribution of sulfurized oils to odors and fumes from process generated heat. Nevertheless, even aqueous fluids containing sulfonated and/or sulfurized oils have not achieved sufficient performance improvement to replace oil based machining fluids in all applications. Hence, there is a continuing need to improve performance of aqueous based machining fluids.

SUMMARY OF THE INVENTION

It is an object of the present invention to provide an aqueous machining fluid for improving mechanical shaping and working of metallic and solid non-metallic workpieces.

It is a further object of this invention to provide an aqueous machining fluid overcoming disadvantages of prior art aqueous machining fluids by providing improved performance of mechanical shaping and working processes.

It is a still further object of this invention to provide an aqueous machining fluid which provides improved performance in grinding processes.

Further objects and advantages of the present invention will become apparent from the following description and appended claims.

There is now provided in accordance with this invention an aqueous machining fluid admixture comprising water, sulfurized oil and a water soluble salt of a dimercaptothiadiazole wherein the weight ratio of the sulfurized oil to the salt of a dimercaptothiadiazole is in the range of from about 15:1 to about 45:1. There is also provided in accordance with this invention a mechanical shaping and working process comprising the steps of contacting a solid workpiece with a tool and supplying to the interface between said tool and said workpiece an aqueous machining fluid admixture comprising water, sulfurized oil and a water soluble salt of a dimercaptothiadiazole wherein the weight ratio of sulfurized oil to water soluble salt of a dimercaptothiadiazole is in the range of from about 15:1 to about 45:1.

DETAILED DESCRIPTION OF THE PREFERRED EMBODIMENT

In the context of this description and the appended claims: the term "admixture" shall mean that which results from placing in physical combination the components of the aqueous machining fluid; the term "aqueous machining fluid" shall mean a workpiece contacting aqueous based fluid employed in the mechanical shaping or working of a workpiece; and the term "workpiece" shall mean that solid object which is being subjected to a mechanical shaping or working process.

Applicants have discovered that the forces encountered in the mechanical shaping and working ("machining") of metallic and solid non-metallic workpieces, can be reduced, tool life increased, and productivity increased through use of the friction reducing effective aqueous machining fluid admixture of this invention comprising water, a sulfurized oil and a water soluble salt of a dimercaptothiadiazole wherein the weight ratio of sulfurized oil to water soluble salt of dimercaptothiadiazole ranges from about 15:1 to about 45:1. Additionally, there is provided in accordance with this invention an aqueous machining fluid admixture comprising water, a sulfurized oil and a water soluble ammonium or alkali metal salt of a dimercaptothiadiazole wherein the weight ratio of sulfurized oil to water soluble ammonium or alkali metal salt of a dimercaptothiadiazole is in the range of from about 15:1 to about 45:1. There is further provided in accordance with this invention an aqueous machining fluid admixture comprising water, a sulfurized oil and a water soluble alkali metal salt of 2,5-dimercapto-1,3,4-thiadiazole wherein the weight ratio of sulfurized oil to water soluble alkali metal salt of 2,5-dimercapto-1,3,4-thiadiazole is in the range of from about 15:1 to about 45:1. Further there is provided in accordance with this invention an aqueous machining fluid admixture comprising water, a sulfurized hydrocarbon oil and a water soluble ammonium or alkali metal salt of dimercaptothiadiazole wherein the weight ratio of sulfurized hydrocarbon oil to said ammonium or alkali metal salt is in the range of from about 15:1 to about 45:1. Still further there is provided in accordance with this invention an aqueous machining fluid admixture comprising water, a sulfurized oil and a water soluble sodium salt of a dimercaptothiadiazole wherein the weight ratio of said sulfurized oil to said sodium salt of a dimercaptothiadiazole is in the range of from about 15:1 to about 45:1. Even further in accordance with this invention there is provided an aqueous machining fluid admixture comprising water, a sulfurized oil and a water soluble alkali metal salt of a dimercaptothiadiazole wherein the weight ratio of said sulfurized oil to said alkali metal salt of dimercaptothiadiazole is in the range of from about 17:1 to about 35:1. An aqueous machining fluid admixture is provided in accordance with this invention comprising water, a sulfurized oil and a water soluble disodium-2,5-dimercapto-1,3,4-thiadiazole wherein the weight ratio of the sulfurized oil to the disodium-2,5-dimercaptothiadiazole in the ranger of from about 15:1 to 45:1, more especially 17:1 to 35:1.

Various sulfurized oils may be employed in the practice of this invention. These sulfurized oils include but are not limited to sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof and sulfurized hydrocarbons.

Sulfurized unsaturated aliphatic carboxylic acids having from 6 to 22 carbon atoms usable in the practice of this invention may be prepared from aliphatic monocarboxylic and dicarboxylic acids having from 1 to 3 ethylenically unsaturated groups by methods well known in the art and thus include the sulfurized aliphatic monocarboxylic acids and dicarboxylic acid products which may have none or some of the ethylenically unsaturated groups originally present in the carboxylic acid. Prior art methods for sulfurizing unsaturated aliphatic carboxylic acids include methods for reacting such acids with sulfur, hydrogen sulfide, sodium sulfide, sulfur halide, sulfur dioxide or like sulfurizing agents, often at elevated temperatures and optionally in the presence of an inert solvent. Examples of the sulfurized unsaturated aliphatic carboxylic acids having from 6 to 22 carbon atoms usable in this invention include, but are not limited to, the sulfurized products resulting from the sulfurization of sorbic, oleic, linoleic, linolenic, eleostearic, licanic, ricinoleic, plamitoleic, petroselenic, vaccenic, erucic and stearolic acids. Mixtures of sulfurized unsaturated aliphatic carboxylic acids having from 6 to 22 carbon atoms may be used as the sulfurized oil in the practice of this invention. The salts, e.g. ammonium, alkali metal, alkaline earth metal and copper salts, of the sulfurized unsaturated aliphatic carboxylic acids having from 6 to 22 carbon atoms may be used in the practice of this invention, examples of which include, but are not limited to, ammonium, sodium, potassium, calcium, barium and copper salts of sulfurized oleic, linoleic, sorbic and ricinoleic acids.

Sulfurized unsaturated esters of aliphatic carboxylic acids having 1 to 22 carbon atoms usable as the sulfurized oil in accordance with the practice of this invention include the full and partial esters of mono, di, tri hydric alcohols, e.g. ethanol, ethylene glycol and glycerol. The mono, di and tri hydric alcohols from which the esters may be prepared include straight diols and triols and polyoxyalkylene homopolymer and copolymer alcohols, i.e. monohydric alcohol, and diols, i.e. dihydric alcohol, as the alcohol moiety and saturated and unsaturated carboxylic acids as the acid moiety, the requirement being that the resulting ester that is sulfurized be unsaturated. These esters may occur naturally or may be prepared synthetically by esterification methods well known in the art, e.g. base catalyzed esterification reaction between an alcohol such as ethanol and an unsaturated aliphatic carboxylic acid such as oleic acid. The ester may then be sulfurized by reaction with sulfurizing agents like sulfur, hydrogen sulfide, sulfur dioxide, sulfur halide and sodium sulfide by methods well known in the art and previously described herein. Examples of sulfurized unsaturated esters of aliphatic carboxylic acids having 1 to 22 carbon atoms include, but are not limited to, sulfurized methyl oleate, sulfurized hexyl sorbate, sulfurized dodecyllinolenate, and sulfurized ethylene dilinoleate, 1,6 hexylene diricinoleate, glycerine tripalmitoleate, polyoxyethylene dioleate, polyoxypropylene disorbate and glycerine dilinoleate. The sulfurized ester of an unsaturated aliphatic carboxylic acid having from 6 to 22 carbon atoms employed in the aqueous machining fluid compositions in accordance with this invention may be sulfurized fat or a sulfurized fatty oil and the fat or fatty oil which has been sulfurized may be of animal or vegetable origin. Examples of such sulfurized fatty oil usable in the practice of this invention include, but are not limited to, sulfurized tallow, sulfurized whale oil, sulfurized palm oil, sulfurized coconut oil, sulfurized rapeseed oil, sulfurized lard oil and sulfurized castor oil. Sulfurized fatty acid esters of polyhydric alcohols naturally occurring or synthetically prepared, may be used as the sulfurized oil in the practice of this invention. Such sulfurized fatty acid esters of polyhydric alcohols may include sulfurized fatty acid esters of alkylene diols, polyoxyalkylene diols and alkylene triols. Additional examples of unsaturated esters that may be sulfurized to produce the sulfurized oil useful in the practice of this invention include, but are not limited to, mallyl stearate, allyl linoleate, oleyl butyrate, oleyl hexanoate, and butene dioleate. The sulfurized fat or fatty oil employed in the practice of this invention may have a sulfur content ranging from 2% to 45% by weight. Preferably the sulfur content should be in the range of from 10% to 20% by weight. Sulfurizing fats and sulfurized fatty oils may be prepared by processes well known in the art, for example reacting a suitable sulfurizing agent such as sulfur, hydrogen sulfide, sulfur halide, sodium sulfide or sulfur dioxide with the fat or fatty oil, often at elevated temperatures, e.g. 50° to 350° C. in the presence or absence of an inert solvent. Sulfurized full and partial fatty acid esters of glycerol or dialcohols, e.g. glycols, may be employed as the sulfurized oil in the practice of this invention.

The sulfurized polymerized unsaturated fatty acids and salts and esters thereof usable as the sulfurized oil in accordance with this invention are generally sulfurized polymerized unsaturated fatty acids that are prepared from polymerized unsaturated fatty acids obtained by polymerizing ethylenically unsaturated fatty acids having from 12 to 36 carbon atoms. Generally the polymerized unsaturated fatty acid contains from 2 to 4 monomeric units, 2 to 4 carboxylic acid groups and residual ethylenic unsaturation. The polymerization of ethylenically unsaturated fatty acids is known in the art and such acids and the methods for polymerization of ethylenically unsaturated fatty acids into dimer, trimer and tetramer acids is known in the art and is generally believed, in the art, to result in a cycloaliphatic ring structure. Thus, for example, the dimer acid derived from linoleic acid reported in the art, can exist in the cis and trans forms. Dimer, trimer and tetramer acids prepared from ethylenically unsaturated fatty acids are commercially available. For example, the dimer of linoleic acid is commercially available as EMPOL 1022 from Emery Industries (EMPOL is a registered trademark of Emery Industries). This dimer acid may contain 2 to 5% of unpolymerized linoleic acid and from 19 to 22% trimer acid. The polymerized ethylenically unsaturated fatty acid may contain a mixture of ethylenically unsaturated fatty acid, dimer acid, trimer acid and tetramer acid in varying proportions depending upon the starting ethylenically unsaturated fatty acid and the conditions under which the polymerization was carried out. Sulfurization of the polymerized unsaturated fatty acid may be achieved by methods well known in the art as previously described herein with respect to unsaturated aliphatic carboxylic acids having from 6 to 22 carbon atoms and the esters thereof. The salts of the sulfurized polymerized unsaturated fatty acid may include, but are not limited to, ammonium, amine, alkali metal, alkaline earth metal and copper, iron, aluminum and like metal salts. Esters of the polymerized unsaturated acids that may be sulfurized to produce the sulfurized oil usable in the practice of this invention include, but are not limited to, mono methyl ester of dimerized linoleic acid, dimethyl ester of dimerized linoleic acid, mono polyoxyalkylene, e.g., polyoxyethylene, glycol ester of dimerized linoleic acid, acid terminated polyoxyalkylene, e.g., polyoxyethylene, glycol diester of dimerized linoleic acid, alcohol terminated polyoxyalkylene, e.g., polyoxyethylene, glycol polyester of dimerized linoleic acid, and alcohol terminated polyoxyalkylene, e.g. polyoxypropylene oxyethylene, glycol polyester of dimerized linoleic acid. Examples of sulfurized polymerized unsaturated fatty acids include, but are not limited to sulfurized polymerized oleic acid, sulfurized polymerized linoleic acid, sulfurized polymerized lauroleic acid, sulfurized polymerized vaccenic acid, sulfurized polymerized eleostearic acid and sulfurized polymerized linolenic acid.

Examples of sulfurized hydrocarbon oils usable in the practice of this invention include, but are not limited to, sulfurized olefin, olefin sulfides, aliphatic hydrocarbon sulfides, e.g., $R^5$-S-$R^6$ where $R^5$ is alkyl of 1 to 20 carbons and $R^6$ is alkyl of 3 to 20 carbons, and sulfurized polyolefin, particularly sulfurized low molecular weight polyolefins. Desirably the sulfurized hydrocarbon oil should have a sulfur content of from 5% to 45% by weight preferably 32% to 42% by weight. The sulfurized hydrocarbon oil may be prepared by methods well known in the chemical art. In one such method an olefin may be reacted with a sulfurizing agent such as sulfur, hydrogen sulfur dioxide at temperatures ranging from 100° to 350° C. in the presence or absence of an inert solvent medium and often in the presence of an inert atmosphere.

The water soluble salts of a dimercaptothiadiazole usable in the practice of this invention include but are not limited to, water soluble ammonium or alkali metal salts of dimercaptothiadiazole. Examples of such alkali metal salts of dimercaptothiadiazole include but are not limited to sodium and potassium salts of dimercaptothiadiazole. Examples of the dimercaptothiadiazole moiety employable in the practice of this invention include 2,5-dimercapto-1,3,4-thiadiazole, 3,5-dimercapto-1,2,4-thiadiazole, 3,4-dimercapto-1,2,5-thiadiazole and 4,5-dimercapto-1,2,3-thiadiazole. The 2,5-dimercapto-1,3,4-thiadiazole, for example, may be prepared by reacting 1 mole of hydrazine or a salt of hydrazine with 2 moles of carbon disulfide in an alkaline medium, the thiadiazole being recovered by acidification of the reaction. Sodium salts of dimercaptothiadiazole are preferred in the practice of this invention and include, for example, disodium-2,5-dimercapto-1,3,4-thiadiazole, disodium-3,4-dimercapto-1,2,5-thiadiazole, disodium-3,5-dimercapto-1,2,4-thiadiazole and disodium-4,5-dimercapto-1,2,3-thiadiazole with the disodium-2,5-dimercapto-1,3,4-thiadiazole being even further preferred in the practice of this invention. Mixtures of water soluble salts of dimercaptothiadiazoles may be employed in the practice of this invention. Such mixtures may be mixtures of water soluble alkali metal salts of dimercaptothiadiazoles, e.g., sodium and potassium salts of dimercaptothiadiazoles, disodium-2,5-dimercapto-1,3,4-thiadiazole and disodium-3,5-dimercapto-1,2,4-thiadiazole.

It has been discovered that significantly improved performance in the grinding of metal workpieces can be achieved with the use of the aqueous machining fluid admixture of this invention. Such improved grinding performance is manifested in several grinding factors and especially in the grinding ratio ("G-ratio"), i.e. the ratio of the volume of material removed from the workpiece to the volume reduction of the grinding wheel during the grinding operation. Higher G-ratios are indicative of better grinding performance. The higher G-ratios produced with aqueous fluids of this invention reduce friction, permit grinding with reduced forces and extend the useful life of grinding wheels by reducing the rate of reduction of wheel volume in grinding processes. It has been unexpectedly discovered that the significantly improved grinding performance obtained with use of the aqueous machining fluid admixture of this invention is produced by the weight ratio of the sulfurized oil to the water soluble salt of dimercaptothiadiazole in the fluid admixture being within the range of from about 15:1 to about 45:1, more especially about 17:1 to about 35:1, as compared to a) a comparable aqueous machining fluid containing sulfurized oil without a water soluble salt of dimercaptothiadiazole and b) a comparable aqueous machining fluid containing a sulfurized oil and a water soluble salt of dimercaptothiadiazole at a weight ratio outside the range of from about 15:1 to about 45:1. This significantly improved grinding performance was not to be learned or expected from the prior art and provides an advance over such art.

The concentration of sulfurized oil and water soluble salt of a dimercaptothiadiazole may vary over a wide range in the practice of this invention. Sulfurized oil concentrations in the aqueous machining fluid admixture of this invention may, for example, range from about 0.01 to about 5 percent by weight, more especially from about 0.05 to about 4 percent by weight. Concentration of the water soluble salt of a dimercaptothiadiazole in the aqueous machining fluid admixture according to this invention may be, for example, in the range of from about 0.003 to about 5 percent by weight. It is however required that the concentrations of sulfurized oil and water soluble salt of a dimercaptothiadiazole are such that the weight ratio of sulfurized oil to water soluble salt of a dimercaptothiadiazole is in the range of from about 15:1 to about 45:1.

There may be added to the aqueous machining fluid admixture of this invention, in conventional amounts well known in the art, corrosion inhibitors, e.g., triethanolamine, auxiliary lubricants, e.g. oleic, linoleic acids and mixtures thereof, bactericides, fungicides, antioxidants, surfactants, antifoaming agents, coloring agents and metal precipitating agents.

It is well known in the art to prepare and ship aqueous based machining fluids in a concentrated form. Such concentrated form is then diluted with water to a use concentration by the end user, i.e., the user of the fluid, and the diluted fluid employed in machining operations. The concentrated form of the fluid usually contains a small amount of water, typically less than 10% by weight. However, larger amounts of water may be in the fluid prepared and shipped which may then be diluted further with water to produce an end use concentration of the fluid. The advantage to preparing and shipping the concentrated form of the aqueous machining fluid is that it avoids sending large quantities of water from the producer of the fluid to the end user of the fluid since the user can economically add water to the fluid to obtain the required use concentration. Thus preparing and shipping of the concentrated form of the aqueous machining fluid provides an economic advantage over preparing and shipping the diluted fluid in an end use concentration. In the context of this description and the appended claims it is however intended and shall be understood that the aqueous machining fluid admixture in accordance with this invention shall include the concentrated form, the diluted form for end use and all concentrations therebetween.

The aqueous machining fluid admixture of this invention may be prepared by means well known in the art. The order of the addition of components to the admixture may be varied to suit the chemical and physical characteristics of such components. It is intended and shall be understood that the aqueous machining fluid admixture in accordance with this invention is not to be limited by the manner of preparation of the fluid.

Aqueous machining fluid admixtures in accordance with this invention are usable in the mechanical working and shaping of metallic and solid non-metallic workpieces by cutting and non-cutting processes. The aqueous machining fluid admixtures according to this invention are particularly useful in the grinding of metallic workpieces.

This invention will now be further described in the following non-limiting examples in which the quantities of components are in percentage by weight unless otherwise indicated.

EXAMPLE 1

Disodium-2,5-dimercapto-1,3,4-thiadiazole 0.425
Sulfurized lard oil (14%–16% sulfur) 0.475
Olefin sulfide (36%–39% sulfur) 0.180
Emulsifier (1) 1.365
Triethanolamine 2.500
Neodecanoic acid 0.050
Water 95.005

This example has a sulfurized oil to disodium-2,5-dimercapto-1,3,4-thiadiazole weight ratio of 1.54:1 and is not in accordance with this invention.

EXAMPLE 2

Disodium-2,5-dimercapto-1,3,4-thiadiazole 0.200
Olefin sulfide (36%–39% sulfur) 1.750
Napthenic lube oil 2.130
Emulsifier (2) 0.670
Oleic acid/Linoleic acid mixture 0.225
Triethanolamine 0.175
Water 94.850

This example has a sulfurized oil to disodium-2,5-dimercapto-1,3,4-thiadiazole weight ratio of 8.75:1 and is not in accordance with this invention.

EXAMPLE 3

Disodium-2,5-dimercapto-1,3,4-thiadiazole 0.250
Olefin sulfide (36%–39% sulfur) 3.900
Emulsifier (2) 0.400
Oleic acid/Linoleic acid mixture 0.200
Triethanolamine 0.175
Water 94.075

This example has a sulfurized oil to disodium-2,5-dimercapto-1,3,4-thiadiazole weight ratio of 15.6:1.

EXAMPLE 4

Disodium-2,5-dimercapto-1,3,4-thiadiazole 0.100
Olefin sulfide (36%-39% sulfur) 1.750
Napthenic lube oil 2.130
Emulsifier (2) 0.670
Oleic acid/Linoleic acid mixture 0.225
Triethanolamine 0.175
Water 94.950

This example has a sulfurized oil to disodium-2,5-dimercapto-1,3,4-thiadiazole weight ratio of 17.5:1.

EXAMPLE 5

Disodium-2,5-dimercapto-1,3,4-thiadiazole 0.1425
Olefin sulfide (36%–39% sulfur) 3.7250
Emulsifiers (2) 0.6700
Oleic acid/Linoleic acid mixture 0.2250
Triethanolamine 0.1750
Water 95.0625

This example has a sulfurized oil to disodium-2,5-dimercapto-1,3,4-thiadiazole weight ratio of 26.1:1.

EXAMPLE 6

Disodium-2,5-dimercapto-1,3,4-thiadiazole 0.050
Olefin sulfide (36%-39% sulfur) 1.750
Napthenic lube oil 2.130
Emulsifier (2) 0.670
Oleic acid/Linoleic acid mixture 0.225
Triethanolamine 0.175
Water 94.950

This example has a sulfurized oil to disodium-2,5-dimercapto-1,3,4-thiadiazole weight ratio of 35:1.

EXAMPLE 7

Disodium-2,5-dimercapto-1,3,4-thiadiazole 0.425
Sulfurized oils (14–16% sulfur) 0.350
Olefin sulfide (36%–39% sulfur) 0.135
dibutyidithiocarbamate 0.170
Emulsifier (1) 1.365
Triethanolamine 2.500
Neocanoic acid 0.050
Water 95.005

This example has a sulfurized oil to disodium-2,5-dimercapto-1,3,4-thiadiazole weight ratio of 1.14:1 and is not in accordance with this invention.

(1) Nonylphenol ethoxylated with 9.3 moles of ethylene oxide.

(2) 1:1 by weight mixture of TERGITOL NP-9 and POLY-TERGENT B-200.

TERGITOL NP-9 is an alkyl nonylphenol ethoxylated with 9.5 moles of ethylene oxide available from the Union Carbide Corp. TERGITOL is a registered trademark of the Union Carbide Corp.

POLY-TERGENT B-200 is an alkyl nonylphenol ethoxylated with 6 moles of ethylene oxide available from Olin Chemical Company. POLY-TERGENT is a registered trademark of Olin Chemical Company.

TABLE

| Example | Weight Ratio* | G-Ratio |
|---|---|---|
| 1 | 1.54:1 | 9.5 |
| 2 | 8.75:1 | 25.5 |
| 3 | 15.6:1 | 58.5 |
| 4 | 17.5:1 | 79.5 |
| 5 | 25.6:1 | 83.5 |
| 6 | 35.0:1 | 43.5 |
| 7 | 1.14:1 | 8.5 |

*Weight ratio is the weight ratio of sulfurized oil to the salt of a dimercaptothiadiazole.

TEST PROCEDURE

The G-Ratio data reported in Table 1 was obtained for each of the Examples using the following surface grinding test procedure. An aluminum oxide grinding wheel, rotating at 6000 surface feet per minute, was forced against and passed over a 100 square inch flat surface of a block of SAE 8617 steel. The grinding wheel was advanced towards the block by a constant incremental distance every two passes of the wheel across the block surface, whereby the majority of material removal occurs in the first of the passes following an advance increment and deflections are eliminated in the second pass. The interface between the grinding wheel and the steel block was flooded with test fluid which was recirculated from a reservoir through the grinding wheel/block interface and back to the reservoir. Repeated grinding passes were made over the steel block for a test period of 20 minutes. The volumes of the grinding wheel and the steel block were measured before and after the test for determining the volume of grinding wheel reduction and the volume of material removed from the block, the measurements being made in the same units of measure for both grinding wheel and block. G-Ratio was then calculated by dividing the volume of grinding wheel reduction into the volume of material removed from the block.

What is claimed is:

1. An aqueous machining fluid admixture comprising water, a sulfurized oil selected from the group consisting of sulfurized unsaturated aliphatic carboxylic acids having from 6 to 22 carbon atoms and salts thereof, sulfurized unsaturated esters of aliphatic carboxylic acids having from 1 to 22 carbon atoms, sulfurized polymerized unsaturated fatty acids and salts and esters thereof and mixtures thereof and sulfurized hydrocarbons, and a water soluble salt of a dimercaptothiadiazole wherein the weight ratio of the sulfurized oil to the salt of a dimercaptothiadiazole is in the range of from about 15:1 to about 45:1.

2. An aqueous machining fluid admixture according to claim 1 wherein the water soluble salt of a dimercaptothiadiazole is a water soluble ammonium or alkali metal salt of a dimercaptothiadiazole.

3. An aqueous machining fluid admixture according to claim 1 wherein the weight ratio is in the range of from about 17:1 to about 35:1.

4. The aqueous machining fluid admixture according to claim 2 wherein the weight ratio is in the range of from about 17:1 to about 35:1.

5. The aqueous machining fluid admixture according to claim 2 wherein the water soluble salt of a dimercaptothiadiazole is a water soluble alkali metal salt of a dimercaptothiadiazole.

6. An aqueous machining fluid admixture according to claim 5 wherein the weight ratio is in the range of from about 17:1 to about 35:1.

7. An aqueous machining fluid admixture according to claim 5 wherein the water soluble alkali metal salt of a dimercaptothiadiazole is disodium-2,5-dimercapto-1,3,4-thidiazole.

8. An aqueous machining fluid admixture according to claim 6 wherein the water soluble alkali metal salt of a dimercaptothiadiazole is disodium-2,5-dimercapto-1,3,4-thiadiazole.

9. An aqueous machining fluid admixture according to claim 5 wherein the alkali metal is sodium.

10. An aqueous machining fluid admixture according to claim 5 wherein the alkali metal is potassium.

11. An aqueous machining fluid admixture according to claim 2 wherein the sulfurized oil is a sulfurized hydrocarbon oil.

12. An aqueous machining fluid admixture according to claim 2 wherein the sulfurized oil is a sulfurized organic ester.

13. An aqueous machining fluid admixture according to claim 2 wherein the sulfurized oil is a sulfurized fatty acid.

14. An aqueous machining fluid admixture according to claim 5 wherein the sulfurized oil is an olefin sulfide oil.

15. An aqueous machining fluid admixture according to claim 8 wherein the sulfurized oil is a sulfurized olefin sulfide oil.

16. An aqueous machining fluid admixture according to claim 11 wherein the sulfurized hydrocarbon oil is an olefin sulfide oil.

17. A method for machining comprising the steps of contacting a workpiece with a tool for shaping the workpiece and contacting the interface between the workpiece and tool with an aqueous machining fluid admixture comprising water, a sulfurized oil selected from the group consisting of sulfurized unsaturated aliphatic carboxylic acids having from 6 to 22 carbon atoms and salts thereof. sulfurized unsaturated esters of aliphatic carboxylic acids having from 1 to 22 carbon atoms. sulfurized polymerized unsaturated fatty acids and salts and ester thereof and mixtures thereof and sulfurized hydrocarbons, and a water soluble salt of a dimercaptothiadiazole wherein the weight ratio of the sulfurized oil to the salt of a dimercaptothiadiazole is in the range of from about 15:1 to about 45:1.

18. The method of claim 17 wherein the water soluble salt of the aqueous machining fluid admixture is a water soluble ammonium or alkali metal salt of a dimercaptothiadiazole.

19. The method of claim 18 wherein the water soluble alkali metal salt of a dimercaptothiadiazole is disodium-2,5-dimercapto-1,3,4-thiadiazole.

20. The method of claim 19 wherein the weight ratio of sulfurized oil to disodium-2,5-dimercapto-1,3,4-thiadiazole of the aqueous machining fluid is from about 17:1 to about 35:1.

* * * * *